US005243384A

United States Patent [19]

Everdyke et al.

[11] Patent Number: 5,243,384

[45] Date of Patent: Sep. 7, 1993

[54] CUSTOMER REPLACEABLE BELT MODULE

[75] Inventors: Wayne D. Everdyke, Fairport; Mark S. Jackson, Rochester, both of N.Y.

[73] Assignee: Xerox Corporation, Stamford, Conn.

[21] Appl. No.: 676,500

[22] Filed: Mar. 28, 1991

[51] Int. Cl.[5] ..... G03G 5/00

[52] U.S. Cl. ..... 355/212; 355/200; 355/210

[58] Field of Search ..... 355/200, 210, 212, 211

[56] References Cited

U.S. PATENT DOCUMENTS

| | | | |
|---|---|---|---|
| 4,279,496 | 7/1981 | Silverberg | 355/212 |
| 4,470,690 | 9/1984 | Hoffman | 355/212 |
| 4,563,077 | 1/1986 | Komada | 355/212 |
| 4,616,920 | 10/1986 | Itoigawa et al. | 355/212 X |
| 4,626,095 | 12/1986 | Berger | 355/212 X |
| 4,657,369 | 4/1987 | Takeuchi | 355/212 |
| 4,739,371 | 4/1988 | Ray et al. | 355/212 |

*Primary Examiner*—A. T. Grimley
*Assistant Examiner*—Shuk Y. Lee
*Attorney, Agent, or Firm*—H. Fleischer; J. E. Beck; R. Zibelli

[57] ABSTRACT

A module adapted to be mounted removably in a printing machine. The module has a photoconductive belt entrained about a plurality of rollers mounted on a frame. One of the rollers is movable between a non-operative position, in which the space between the rollers is reduced, and an operative position, in which the space between the rollers is increased. A charging station and a cleaning station are mounted on the frame of the module adjacent the photoconductive belt. When one of the rollers is in the non-operative position, a cover covers at least the photoconductive belt. The cover has an insert about which a portion of the photoconductive is wrapped. The insert supports the photoconductive belt in a non-tensioned condition external to the printing machine.

10 Claims, 3 Drawing Sheets

CUSTOMER REPLACEABLE BELT MODULE

This invention relates generally to an electrophotographic printing machine, and more particularly concerns a replaceable module adapted for use therein.

In an electrophotographic printing machine, a photoconductive member is charged to a substantially uniform potential to sensitize the surface thereof. The charged portion of the photoconductive member is exposed. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a powder image on the photoconductive member which is subsequently transferred to a copy sheet. The copy sheet is heated to permanently affix the marking particles thereto in image configuration. Electrophotographic printing machines include copiers and printers. A light lens copier has the charged portion of the photoconductive member exposed to a light image of an original document being reproduced. A digital copier has a raster input scanner which scans the original document and generates signals which modulate laser beam exposing the charged portion of the photoconductive member. A printer has the charged portion of the photoconductive member exposed to a light image generated by a laser beam. The laser beam is modulated by input signals from a computer. Multi-color electrophotographic printing machines have four individual developer unit. The photoconductive belt must be precisely aligned relative to these developer units in order to achieve the desired copy quality.

In order to reduce service costs, it is desirable to use a customer replaceable unit having a photoconductive belt and other short life components. However, in order to use a customer replaceable unit in a multicolor electrophotographic printing machine, it is necessary to precisely locate the photoconductive belt relative to each of the developer units. In addition, precise control of photoconductive belt motion is required to suppress half tone banding. Various types of replaceable photoconductive belt units have hereinbefore been used as illustrated by the following disclosures, which may be relevant to certain aspects of the present invention:

U.S. Pat. No. 4,470,690
Patentee: Hoffman
Issued: Sep. 11, 1984
U.S. Pat. No. 4,563,077
Patentee: Komada
Issued: Jan. 7, 1986
U.S. Pat. No. 4,616,920
Patentee: Itoigawa et al.
Issued: Oct. 14, 1986
U.S. Pat. No. 4,626,095
Patentee: Berger
Issued: Dec. 2, 1986
U.S. Pat. No. 4,657,369
Patentee: Takeuchi
Issued: Apr. 14, 1987

The relevant portions of the foregoing patents may be briefly summarized as follows:

U.S. Pat. No. 4,470,690 discloses a removably mounted electrophotographic belt assembly for an electrostatic copier. The belt assembly is a self-contained unit having side plates and a pair of rollers about which the belt is entrained.

U.S. Pat. No. 4,563,077 describes a removable belt module mechanism for an image recording apparatus. The belt module has a drive roller, an idler roller, a tension roller and a photoreceptor belt. The tension roller is actuated by a spring. A set of guides are provided to guide the belt module into the recording apparatus.

U.S. Pat. No. 4,616,920 discloses a copying machine having a belt module. The belt module has an endless photoreceptor belt, two rollers and a lid. The lid covers the belt module and protects sit from light exposure. A tension lever adjusts the distance between two rollers to regulate the tension on the photoreceptor belt.

U.S. Pat. No. 4,626,095 describes photoreceptor belt holder drawer for a copier. The drawer has two cylinder. One of the cylinders is mounted movably to adjust the tension on the belt.

U.S. Pat. No. 4,657,369 discloses a disposable photoconductive belt assembly. The belt assembly has a photoconductive belt, two rollers, a charging unit, mount for detachably mounting the assembly in a printer or a copier. A photosensor is also included with the assembly to assist in locating the belt seam. Several guides are provided to guide and mount the belt assembly vertically in the printer or copier. A handle is provided to aid in removal of the assembly. Belt tension is factory set.

Pursuant to the features of the present invention, there is provided a replaceable module adapted for use in a printing machine. The module includes a frame having a plurality of rollers mounted thereon. A photoconductive belt is entrained about the rollers. Means are provided for moving one of the rollers between a non-operative position, in which the space between said plurality of rollers is reduced, and an operative position, in which the space between said plurality of rollers is increased. A plurality of processing stations are mounted on the frame adjacent the photoconductive belt. The processing stations are adapted to perform a series of operations during the recording of an electrostatic latent image on said photoconductive belt. Means cover at least the photoconductive belt with one of the rollers being in the non-operative position. The covering means has an insert adapted to have at least a portion of the photoconductive belt wrapped thereabout. The insert supports the photoconductive belt in a non-tensioned condition external to the printing machine.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
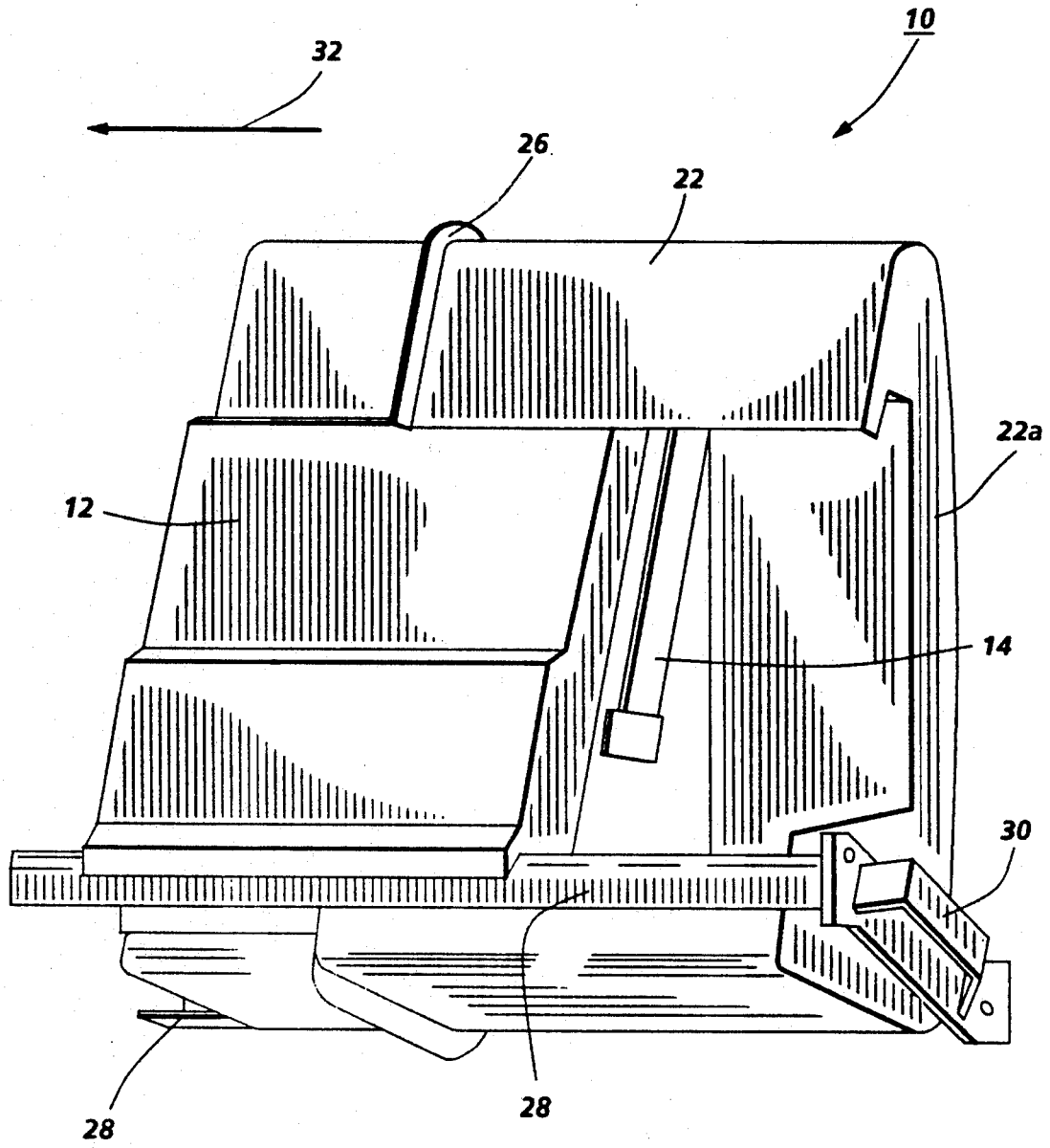
FIG. 1 is a perspective view showing the replaceable belt module assembly of the present invention.

For a general understanding of the features of the present invention, reference is made to the drawings. In the drawings, like references have been used throughout to designate identical elements. FIG. 1 depicts the replaceable belt module external to the printing machine.

Figure 2:
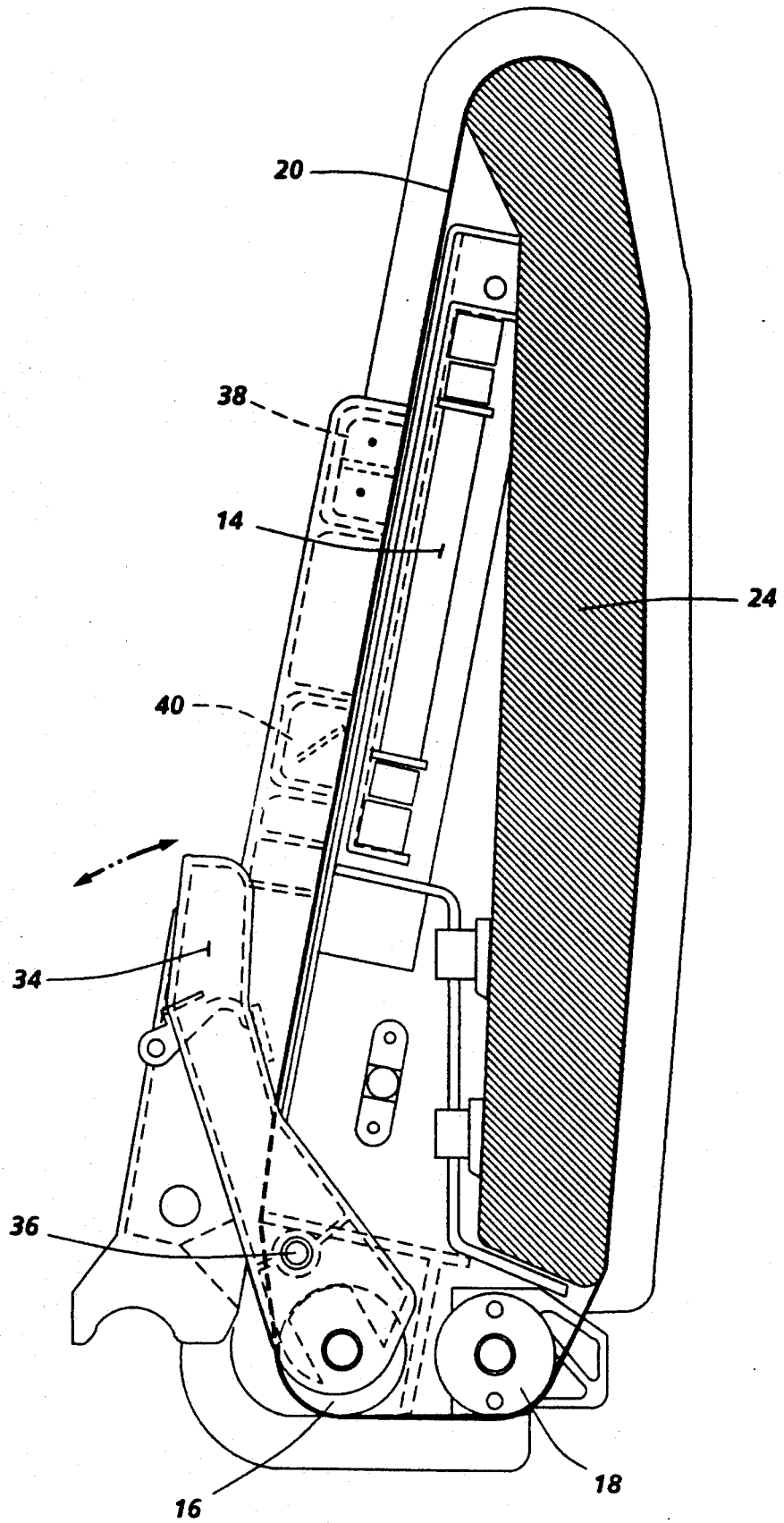
FIG. 2 is a schematic elevational view illustrating the insert of the belt module assembly maintaining the photoconductive belt in a non-tensioned condition.

Turning to FIG. 1, the replaceable belt module, indicated generally by the reference numeral 10, has a frame 12 with lever 34 (FIGS. 2 and 3) mounted pivotably thereon. Actuation of lever 34 changes the spacing between rollers 16 and 18 (FIGS. 2 and 3) supporting photoconductive belt 20 (FIG. 2). Cover 22 is mounted slidably on frame 12. Handle 14 is provided to hold the module while it is being inserted into the printing machine. Cover 22 is adapted to cover and protect photoconductive belt 20 to prevent damage thereto. Cover 22 has an insert 24 extending therefrom and being adapted to support belt 20 in a non-tensioned condition. A flange 26 extends outwardly from an end region of cover 22. A pair of spaced guide rails 28 are attached to cover 22 and support frame 12 slidably thereon. A handle 30 is attached to end 22*a* of cover 22. Handle 30 is a substantially U-shaped member.

Figure 3:
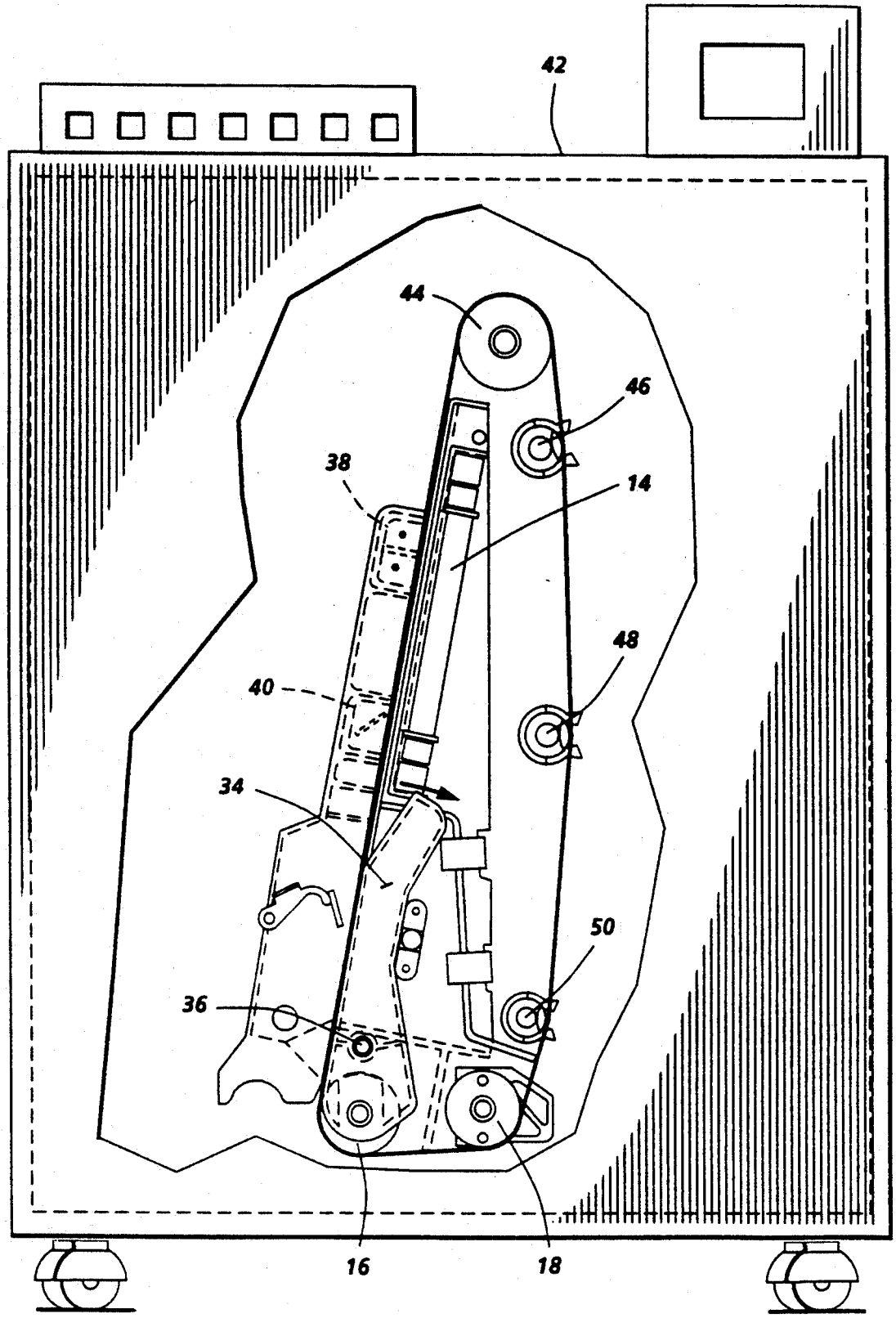
FIG. 3 is a schematic elevational view depicting the belt module in a printing machine.

In operation, the operator slides module 10 in the direction of arrow 32 into the printing machine. As the module is advanced into the printing machine, flange 26 of cover 22 engages a detent in the printing machine. This prevents cover 22 from entering the printing machine and, as belt module 10 continues to move in the direction of arrow 32, cover 22 slides away from frame 12. In this way, both cover 22 and insert 24 supporting belt 20 are automatically removed from frame 12. FIG. 3 illustrates frame 12 mounted in the printing machine.

Referring now to FIG. 2, there is shown insert 24 extending from cover 22 (FIG. 1) supporting belt 20 in a non-tensioned condition. As shown thereat, lever 34 is connected to shaft 36. Roller 16 is mounted rotatably on one end of lever 34. Lever 34 is mounted pivotably on frame 12 and pivots about shaft 36. In FIG. 2, lever 34 is pivoted to reduce the space between roller 16 and roller 18. In this way, belt 20 is in the non-tensioned condition. A charging unit 38 having a corona generator, is mounted on frame 12. When operating in the printing machine, corona generator 38 is adapted to charge photoconductive belt 20 to a substantially uniform level. In addition, a cleaning unit 40 having a cleaning brush, is also mounted on frame 12. In operation, the cleaning unit is adapted to removed residual particles from photoconductive belt 20 after the developed image has been transferred to a sheet of support material. The remaining processing units, such as the developer units, transfer unit, and fusing unit are mounted in the printing machine. When module 10 is mounted in the printing machine, each of the processing units are properly aligned relative thereto. FIG. 3 shows the module in the printing machine 42 with the cover and insert removed therefrom.

As depicted in FIG. 3, frame 12 is mounted in printing machine 42. Cover 22 having insert 24 has been automatically removed from frame 12 as the module slides into the printing machine. In the printing machine, belt 20 is entrained about rollers 16 and 18, and encoder roller 44. In addition, belt 20 passes over backer bars 46, 48 and 50. Backer bars 46, 48 and 50 precisely locate belt 20 relative to each of three different color developer units in the printing machine. After frame 12 is seated in the printing machine, the operator pivots lever 34. Lever 34 pivots about shaft 36 so as to increase the space between rollers 16 and 18. This places belt 20 in a tensioned condition. After belt 20 is tensioned, the printing machine is operational.

In recapitulation, the replaceable module of the present invention is adapted for use in a printing machine. The module has a photoconductive belt entrained about a pair of rollers and an insert extending from a cover. The rollers are mounted on a frame. The cover protects the photoconductive belt. The photoconductive belt is in a non-tensioned condition in which the space between the rollers is reduced. Charging and cleaning units are also mounted on the frame. As the module is slidably mounted in the printing machine, the cover and insert are automatically removed therefrom. In the printing machine, the photoconductive belt is entrained about the rollers, an encoder roller and backing bars. The rollers are now moved further apart to tension the belt. The operator has now completed loading the module in the printing machine.

It is, therefore, evident that there has been provided in accordance with the present invention, a replaceable module that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

We claim:

1. A replaceable module adapted for use in a printing machine, including:
   - a frame;
   - a plurality of rollers mounted on said frame;
   - a photoconductive belt entrained about said plurality of rollers;
   - means for moving one of said plurality of rollers between a non-operative position, in which a space between said plurality of rollers is reduced, and an operative position, in which the space between said plurality of rollers is increased;
   - a plurality of processing stations mounted on said frame adjacent said photoconductive belt and adapted to perform a series of operations during a recording of an electrostatic latent image on said photoconductive belt; and
   - means for covering at least said photoconductive belt with one of said plurality of rollers being in the non-operative position, said covering means having an insert adapted to have at least a portion of said photoconductive belt wrapped thereabout and being supported in a non-tensioned condition external to the printing machine.

2. A module according to claim 1, further including means, attached to said covering means, for slidably and removably mounting said frame in the printing machine.

3. A module according to claim 2, wherein said mounting means positions said photoconductive belt vertically in the printing machine.

4. A module according to claim 2, further including a handle attached to said cover, for facilitating the removal and insertion of the module by an operator.

5. A module according to claim 4, further including a lever located externally of said covering means and operatively associated with said moving means to enable the operator to actuate said lever so that said moving means moves said one of said plurality of rollers between the non-operative and operative position.

6. A module according to claim 5, wherein said mounting means includes a pair of spaced, substantially parallel guide rails mounted on one end of said covering means.

7. A module according to claim 6 wherein said handle includes a substantially U-shaped member mounted on said covering means adjacent said guide rails.

8. A module according to claim 4, wherein said processing stations include:

means for charging said photoconductive belt; and means for cleaning said photoconductive belt.

9. A module according to claim 4, further including means for automatically removing said covering means and the insert from said photoconductive belt as the module is being inserted into the printing machine.

10. A module according to claim 9, wherein said removing means includes a flange extending outwardly from the end of said covering means adapted to engage a portion of the printing machine as the module is being inserted into the printing machine preventing said covering means and the insert from advancing into the printing machine.

* * * * *